US011208749B2

(12) United States Patent
Xu et al.

(10) Patent No.: US 11,208,749 B2
(45) Date of Patent: Dec. 28, 2021

(54) WASHING MACHINE CONTROL METHOD AND WASHING MACHINE

(71) Applicant: QINGDAO HAIER DRUM WASHING MACHINE CO., LTD., Shandong (CN)

(72) Inventors: Sheng Xu, Shandong (CN); Zhenxing Huang, Shandong (CN); Wenwei Li, Shandong (CN); Jun Wu, Shandong (CN); Hai Shu, Shandong (CN)

(73) Assignee: QINGDAO HAIER DRUM WASHING MACHINE CO., LTD., Shandong (CN)

( * ) Notice: Subject to any disclaimer, the term of this patent is extended or adjusted under 35 U.S.C. 154(b) by 133 days.

(21) Appl. No.: 16/607,564

(22) PCT Filed: Apr. 11, 2018

(86) PCT No.: PCT/CN2018/082604

§ 371 (c)(1),
(2) Date: Oct. 23, 2019

(87) PCT Pub. No.: WO2018/196611

PCT Pub. Date: Nov. 1, 2018

(65) Prior Publication Data

US 2020/0141038 A1 May 7, 2020

(30) Foreign Application Priority Data

Apr. 24, 2017 (CN) ..... 201710271805.3

(51) Int. Cl.
*D06F 33/00* (2020.01)
*D06F 34/05* (2020.01)
(Continued)

(52) U.S. Cl.
CPC ..... *D06F 34/05* (2020.02); *D06F 33/32* (2020.02); *D06F 37/42* (2013.01); *D06F 2103/40* (2020.02); *D06F 2105/62* (2020.02)

(58) Field of Classification Search
CPC ..... D06F 33/00
See application file for complete search history.

(56) References Cited

U.S. PATENT DOCUMENTS

2016/0215430 A1 7/2016 Ha et al.

FOREIGN PATENT DOCUMENTS

CM 105780401 A 7/2016
CN 201420183 Y 3/2010
(Continued)

OTHER PUBLICATIONS

International Search Report (PCT/ISA/210) dated Jun. 5, 2018, by the State Intellectual Property Office of the P.R. China as the International Searching Authority for International Application No. PCT/CN2018/082604.

(Continued)

*Primary Examiner* — Jason Y Ko
(74) *Attorney, Agent, or Firm* — Buchanan Ingersoll & Rooney PC

(57) ABSTRACT

A washing machine control method is provided. A washing machine has a remote control function. After the washing machine is powered off and then restarted, the remote control function is controlled to be enabled/disabled according to an unlocked/locked state of a door lock. The washing machine control method is applicable to the field of Internet of Things (Internet of Things) washing machines, and may effectively guarantee the safety of an Internet of Things washing machine in remote control and avoid occurrence of safety accidents. Meanwhile, a washing machine using the washing machine control method is further disclosed.

13 Claims, 1 Drawing Sheet

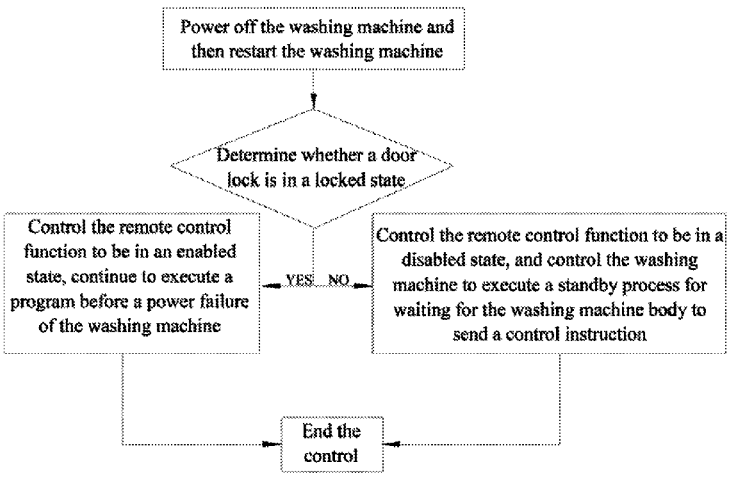

(51) Int. Cl.

| | |
|---|---|
| ***D06F 37/42*** | (2006.01) |
| ***D06F 33/32*** | (2020.01) |
| *D06F 103/40* | (2020.01) |
| *D06F 105/62* | (2020.01) |

(56) References Cited

FOREIGN PATENT DOCUMENTS

| | | | |
|---|---|---|---|
| CN | 105088648 | A | 11/2015 |
| CN | 105594221 | A | 5/2016 |
| CN | 206052400 | U | 3/2017 |

OTHER PUBLICATIONS

Written Opinion (PCT/ISA/237) dated Jun. 5, 2018, by the State Intellectual Property Office of the P.R. China as the International Searching Authority for International Application No. PCT/CN2018/082604.

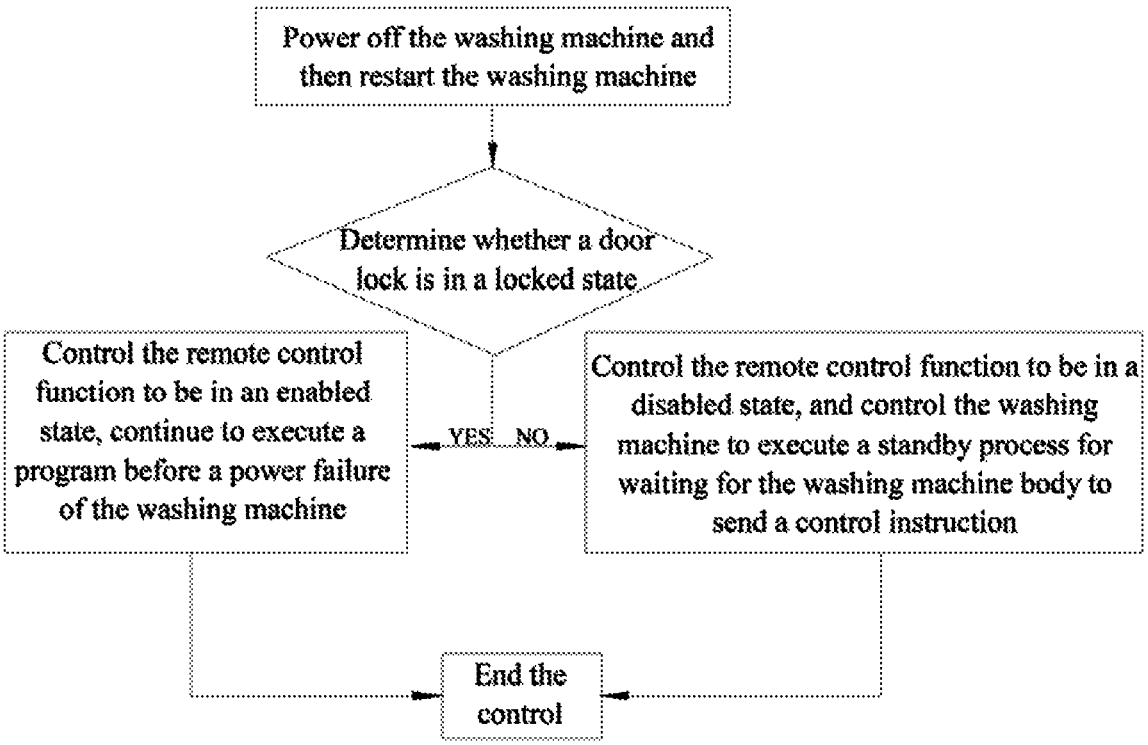
Power off the washing machine and then restart the washing machine
Determine whether a door lock is in a locked state
YES
NO
Control the remote control function to be in an enabled state, continue to execute a program before a power failure of the washing machine
Control the remote control function to be in a disabled state, and control the washing machine to execute a standby process for waiting for the washing machine body to send a control instruction
End the control

WASHING MACHINE CONTROL METHOD AND WASHING MACHINE

TECHNICAL FIELD

The present disclosure relates to the field of washing machines, and particularly relates to an Internet of Things washing machine control method and a washing machine.

BACKGROUND

The Internet of Things (Internet of Things) is another global informatization trend following the computers. Internets and mobile communication networks. Since 1999, the concept of Internet of Things had gradually known by people. It is regarded as a next trillion-level information technology after the Internets. In recent years, countries in the world are stepping up to research the Internet of Things technology.

The development of the Internet of Things is divided into four stages. The first stage is the networking of mainframes and hosts. The second stage is the connection between desktops as well as laptops and the Internet. The third stage is the interconnection of some mobile devices such as mobile phones. The fourth stage is the rise of embedded Internets. More application equipment closely related to daily lives of people, including washing machines, refrigerators. TVs, microwave ovens, etc., will all join the rank of interconnections to eventually form a globally unified "Internet of Things."

A so-called Internet of Things washing machine is a washing machine that uses an automatic radio frequency identification technology to realize identification between the washing machine and objects. In use, remote control of the Internet of Things washing machine may be realized through a sensing device such as a computer and an intelligent terminal, and a working state of the washing machine can be inquired in real time, and related information of the washing machine is returned through a control system. From a technical point of view, it is a new technology that connects various types of sensors with the existing "Internet", and is an extension of the "Internet" technology. Now, the Internet of Things has been constantly changing the lifestyles and consumption habits of people.

However, different from other Internet of Things products, the washing machine in work has certain safety problems, to which attentions shall be paid. When the washing machine is suddenly powered off unexpectedly in remote control, after the washing machine is restarted, a potential safety hazard may exist if the intelligent terminal is directly continuously authorized to remotely control the washing machine. For example, if someone opens a door cover of the washing machine and does an action (taking out clothes, no more washing) in the power failure of the washing machine, after the washing machine is restarted, the intelligent terminal is directly authorized to continue to control the washing machine, and a remote user does not know that the clothes have been taken out, which may cause the washing machine to idle, and there is a potential safety hazard. Therefore, after the washing machine is restarted, it is necessary to detect whether the washing machine is operated by a person in the power failure to determine whether to continue to authorize the intelligent terminal to remotely control the washing machine. Whether the washing machine is operated by a person (for example, whether someone opens the door cover to take out the clothes) may be determined according to a stale of a door lock of the washing machine.

In view of this, the present disclosure is provided.

SUMMARY

The present disclosure provides a washing machine control method to overcome the disadvantages of the prior art. The washing machine control method is applicable to the field of Internet of Things washing machines and suitable for control of a washing machine after the washing machine is powered off unexpectedly and then restarted, and may effectively guarantee the safety of an Internet of Things washing machine during remote control and avoid occurrence of safety accidents.

To solve the above-mentioned technical problems, the basic idea of the technical solution of the present disclosure is as follows.

A washing machine control method is provided. A washing machine has a remote control function. After the washing machine is powered off and then restarted, the remote control function is controlled to be enabled/disabled according to an unlocked/locked state of a door lock.

Preferably, in the above solution, a control method is mainly defined for a washing machine during the execution of the remote control function after the washing machine is powered off and then restarted. The enabling-disabling of the remote control function specifically represents that: the washing machine authorizes/forbids an intelligent terminal that controls the washing machine before a power failure to continue to control this washing machine after the washing machine is powered on to be restarted.

Preferably, the step of controlling the remote control function to be enabled disabled according to the unlocked/locked state of the door lock includes: detecting whether the door lock is in the locked state after the washing machine is restarted; if a determination result is YES, enabling the remote control function; and if the determination result is NO, controlling the remote control function to be in a disabled state.

Preferably, the control method includes the following steps:

S1, after a washing machine is restarted, determining whether a door lock is in a locked state; if a determination result is YES, proceeding to Step S2; if the determination result is NO, proceeding to Step S3;

S2, controlling the remote control function to be in an enabled state, continuing executing a program before a power failure of the washing machine, and proceeding to Step S4:

S3, controlling the remote control function to be in a disabled state, controlling the washing machine to execute a standby process for waiting for the local machine to send a control instruction, and proceeding to Step S4; and S4, ending the control.

In the above steps, the washing machine determines the state of the remote control function according to the state of the door lock and determines whether to continue executing the program before the power failure. In addition to considering a safety function, the door lock substantially represents whether a user has opened a door cover of the washing machine in the power failure, so that if the user has opened it, the user may possibly take out the clothes, and then it is not necessary to continue the instruction before the power failure when the washing machine is powered on. At this time, the washing machine executes the standby process when powered on.

Further, the control method may include the following steps:

S301, after a washing machine is restarted, determining whether a door lock is in a locked state: if a determination result is YES, proceeding to Step S302: if the determination result is NO, proceeding to Step S303;

S302, controlling the remote control function to be in an enabled state, continuing executing a program before a power failure of the washing machine, and proceeding to Step S304;

S303, detecting whether a door cover is in a closed state; if a determination result is YES, controlling the door lock to be in a locked state, and enabling the remote control function, controlling the washing machine to execute a standby process, and proceeding to Step S304; if the determination result is NO, prompting a user to close the door cover, controlling the remote control function to be in the enabled state when/after detecting that the door cover is closed, controlling the washing machine to execute the standby process, and proceeding to Step S304; and S304, ending the control.

In Step S303, because the door lock is in the unlocked state, the state of the door cover is continuously detected. If the door cover is in an opened state, the user is prompted to close the door cover, and when/after it is detected that the door cover is closed, the remote control function is controlled to be in the enabled state, and the washing machine is controlled to execute the standby process. If the door cover is in a closed state, the door lock is controlled to be in the locked state, the remote control function is enabled, and the washing machine is controlled to execute the standby process. The standby process is that the washing machine temporarily stops executing a command, and waits for the intelligent terminal or the local machine to send an instruction for continuing executing the program before the power failure or the process of re-controlling the washing machine.

Preferably, the above Step S2 or S302 may also include the following steps:

S201, controlling the washing machine to pause and establish communication with the intelligent terminal, but not authorizing the intelligent terminal to remotely control the washing machine, and prompting, by the washing machine through a display screen and or the intelligent terminal, the user to whether to continue executing the program before the power failure, and if the user selects YES, proceeding to Step S202, or proceeding to Step S203;

S202, controlling the remote control function to be in the enabled state, continuing executing the program before the power failure of the washing machine, and proceeding to Step S4 or S304; and S203, maintaining establishment of the communication between the washing machine and the intelligent terminal, controlling the remote control function to be in the disabled state, namely forbidding the intelligent terminal to remotely control the washing machine, and proceeding to Step S4 or S304.

In the above steps, the establishment of the communication between the washing machine and the intelligent terminal means that the intelligent terminal may monitor the state information of the washing machine in real time, such as which step of the program, the rotating speed of a rotary drum and the height of a water level. However, it is different from the enabled state of the remote control function that when the washing machine communicates with the intelligent terminal, the intelligent terminal may not send a control instruction to the washing machine, or the intelligent terminal sends a control instruction to the washing machine, but the washing machine does not execute it. The intelligent terminal may send the control instruction to control the washing machine to execute the instruction only when the remote control function of the washing machine is in the enabled state.

Preferably, in Step S3, the washing machine is controlled to execute the standby process for waiting for the local machine to send the control instruction, the washing machine also executes a prompt program for prompting the user to select to re-control the washing machine or to continue the program before the power failure of the washing machine, and is controlled to execute a corresponding action according to a selection result of the user.

Preferably, in the prompt program, if the washing machine detects that the user selects to re-control the washing machine, the standby process for waiting for the user to input the control instruction is executed. If the washing machine detects that the user selects to continue the program before the power failure of the washing machine, a progress before the power failure of the washing machine is acquired, and the washing machine is controlled to continue to execute the program before the power failure according to the progress.

Preferably, the washing machine includes a touch display screen. The prompt program includes that: the washing machine pops up a dialog box through the touch display screen, and on the dialog box, the user selects whether to continue the program before the power failure of the washing machine.

Preferably, the dialog box includes textual information, confirm option and cancel option corresponding to the textual information. If the washing machine detects that the confirm option is selected, the program before the power failure is continued being executed. If the washing machine detects that the cancel option is selected, the standby process for wailing for the user to input the control instruction is executed.

Preferably, in Step S2, the control method further includes the following steps:

S101, retrieving a washing machine progress before the power failure of the washing machine, determining whether the washing machine is in a dewatering stage at the time of power failure, if a determination result is YES, proceeding to Step S102, and if the determination result is NO, proceeding to Step S103;

S102, controlling the washing machine to re-enter the dewatering program and execute subsequent programs, and proceeding to Step S4; and S103, controlling the washing machine to continue executing the program before the power failure from the time of power failure according to set parameters, and proceeding to Step S4.

Preferably, in the above steps, if it is determined that the washing machine is in the dewatering stage at the time of power failure, it cannot be the same as in other stages at the time of power failure that the washing machine continues executing the program before the power failure from the time point of power failure after being powered on and restarted, because during dewatering, it will take certain time to reach the rotating speed of dewatering. Therefore, the washing machine may be directly controlled to re-execute the dewatering program. Of course, the washing machine may retrieve a rotating speed and a duration of a dewatering drum at the time point of power failure. After the washing machine is restarted, it does not re-execute the dewatering program, but controls the rotating speed of the dewatering drum to reach the rotating speed at the time point of power failure and then starts timing, and the washing machine is controlled to execute the dewatering program of the remaining time.

Preferably, the washing machine includes a lower washing drum and an upper washing drum arranged at the top of the lower washing drum. After the washing machine is restarted, the remote control function is controlled to be enabled/disabled according to a state of a door lock of the upper washing drum and/or the lower washing drum.

Preferably, after the washing machine is restarted, the remote control function is controlled to be enabled/disabled according to the state of the door lock of the lower washing drum.

In the above solution, the lower washing drum is at a relatively low position, so that it is a safety protection region. Therefore, in the present disclosure, it can be designed that the remote control function may be controlled to be enabled disabled according to the state of the door lock of the lower washing drum, and the state of the door lock of the upper washing drum is not related to the enabling/disabling of the remote control function.

Preferably, the washing machine may be remotely controlled through the intelligent terminal. When the intelligent terminal is in communication connection with the washing machine, the intelligent terminal displays slate information of the washing machine in real time, and needs to acquire authorization from the washing machine to send a remote control instruction to control a working state of the washing machine.

Preferably, if the washing machine is remotely controlled through the intelligent terminal before the power failure, after the washing machine is powered off and then restarted, the intelligent terminal is authorized/forbidden to remotely control the washing machine according to the unlocked/locked state of the door lock.

The present disclosure further discloses a washing machine using the above washing machine control method.

The washing machine includes: an upper washing drum, a lower washing drum, a controller and an intelligent terminal.

The upper washing drum is arranged at the lop of the lower washing drum. The upper washing drum and the lower washing drum may cooperate with each other for use, or may be used independently.

The controller is connected with a wireless module for wireless connection with the intelligent terminal.

The intelligent terminal is configured to remotely control the washing machine.

The washing machine may establish communication with die intelligent terminal. When the washing machine establishes communication with the intelligent terminal, the intelligent terminal can monitor the state information of the washing machine in real time, such as which step of the program, the rotating speed of a rotary drum and the height of a water level. However, it is different from the enabled state of the remote control function that although the washing machine communicates with the intelligent terminal, the intelligent terminal may not send a control instruction to the washing machine, or the intelligent terminal sends a control instruction to the washing machine, but the washing machine docs not execute it. The intelligent terminal may send the control instruction to control the washing machine to execute the instruction only when the remote control function of the washing machine is in the enabled state.

Further, the washing machine is provided with an activation device, and the washing machine authorizes-forbids the intelligent terminal to remotely control the washing machine through the activation device. That is, the intelligent terminal sends a remote control request to the washing machine. The washing machine detects whether the activation device is activated after receiving the request. If a detection result is YES, when the suite information of the washing machine is safe, the washing machine authorizes the remote control function to be enabled, or it keeps the remote control function in the disabled state.

If the remote control function is in the enabled state before the washing machine is powered off, it is not necessary to authorize/forbid the intelligent terminal through the activation device to remotely control the washing machine after the washing machine is powered off and then restarted, but the washing machine directly detects whether its state information meets a safety requirement of remote control. If a determination result is YES, the remote control function is directly enabled, or the remote control function is continuously kept in the disabled state. Determining whether the stale information of the washing machine meets the safety requirement of remote control at least includes determining whether the state of the door lock of the lower washing drum is in the locked state. If the state of the door lock of the lower washing drum is in the locked state, it is determined that the state information of the washing machine meets the safety requirement of remote control. If the state of the door lock of the lower washing drum is in the unlocked state, it is determined that the stale information of the washing machine does not meet the safety requirement of remote control.

Through the adoption of the above technical solutions, the present disclosure has the following beneficial effects.

The washing machine control method of the present disclosure mainly defines a control method for a washing machine during the execution of the remote control function after the washing machine is powered off and then restarted. The enabling/disabling of the remote control function specifically represents that: the washing machine authorizes forbids the intelligent terminal that controls the washing machine before the power failure to continue to control this washing machine after the washing machine is powered on to be restarted. The washing machine control method of the present disclosure is applicable to the field of Internet of Things washing machines and suitable tor control of a washing machine after the washing machine is powered off unexpectedly and then restarted, and may effectively guarantee the safely of the Internet of Things washing machine in the remote control and avoid occurrence of safety accidents. When the washing machine is suddenly powered off unexpectedly in the remote control, after the washing machine is restarted, a potential safety hazard may exist if the intelligent terminal is directly continuously authorized to remotely control the washing machine. For example, if someone opens the door cover of the washing machine and does an action (taking out clothes, no more washing) in the power failure of the washing machine, after the washing machine is restarted, the intelligent terminal is directly authorized to continue to control the washing machine, and a remote user does not know that the clothes have been taken out, which may cause the washing machine to idle, and there is a potential safety hazard. Therefore, after the washing machine is restarted, it is necessary to detect whether the washing machine is operated by a person in the power failure to determine whether to continue to authorize the intelligent terminal to remotely control the washing machine. Whether the washing machine is operated by a person (for example, whether someone opens the door cover to take out the clothes) may be determined according to the state of the door lock of the washing machine. Therefore, the safety of users and the safety of the washing machine are fully considered in the design of the washing machine control method of the present disclosure, so that the safely of the Internet of Things washing machine in the remote control may be effectively guaranteed, and the occurrence of the safety accidents is avoided.

The specific implementations of the present disclosure are further described below in detail in combination with the accompanying drawings.

BRIEF DESCRIPTION OF THE DRAWINGS

The drawings constitute one part of this application, and are used to provide a further understanding of the present disclosure. Illustrative embodiments and descriptions thereof of the present disclosure are used to explain the present disclosure, and do not constitute an improper limitation to the present disclosure. Obviously, the drawings described below are only some embodiments, and those skilled in the art can obtain other drawings according to these drawings without paying any creative work.

In the drawings:

FIG. 1 is a logic diagram of a washing machine control method of the present disclosure.

It should be noted that these drawings and text descriptions are not intended to limit the conceptual scope of the present disclosure in any form, but are to describe the concept of the present disclosure to those skilled in the art with reference to specific embodiments.

DETAILED DESCRIPTION

In order to make the objectives, technical solutions and advantages of the embodiments of the present disclosure clearer, the technical solutions in the embodiments will be described clearly and completely below in conjunction with the drawings in the embodiments of the present disclosure. The following embodiments are used to describe the present disclosure, but not intended to limit the scope of the present disclosure.

In the description of the present disclosure, it should be noted that orientations or positional relationships indicated by the terms "upper", "lower", "inside", "outside" and the like are orientations or positional relationships as shown in the drawings, and are only for the purpose of facilitating and simplifying the description of the present disclosure instead of indicating or implying that devices or elements indicated must have particular orientations, and be constructed and operated in the particular orientations, so that these terms are not construed as limiting the present disclosure.

In the description of the present disclosure, it should be noted that unless otherwise explicitly defined and defined, the terms "installed" and "connected" are to be understood broadly, and may be, for example, fixedly connected, or detachably connected, or integrally connected, or mechanically connected, or electrically connected, or directly connected, or indirectly connected through an intermediate medium. Those of ordinary skill in the art can understand the specific meanings of the above terms in the present disclosure according to specific situations.

Embodiment I

The present embodiment provides a washing machine control method. A washing machine has a remote control function. After the washing machine is powered off and then restarted, the remote control function is controlled to be enabled/disabled according to an unlocked/locked stale of a door lock.

Preferably, in the above solution, a control method is mainly defined for a washing machine during the execution of the remote control function after the washing machine is powered off and then restarted. The enabling/disabling of the remote control function specifically represents that: the washing machine authorizes/forbids the intelligent terminal that controls the washing machine before the power failure to continue to control this washing machine after the washing machine is powered on to be restarted.

Preferably, the step that the remote control function is controlled to be enabled-disabled according to the unlocked locked state of the door lock includes that: whether the door lock is in the locked state is detected after the washing machine is restarted: if a determination result is YES, the remote control function is enabled; and if the determination result is NO, the remote control function is controlled to be in a disabled state.

Referring to FIG. 1, the control method includes the following steps that:

S1, after a washing machine is restarted, whether a door lock is in a locked state is determined; if a determination result is YES, Step S2 is proceeded; if the determination result is NO, Step S3 is proceeded;

S2, the remote control function is controlled to be in an enabled state, a program before a power failure of the washing machine is continuously executed, and Step S4 is proceeded;

S3, the remote control function is controlled to be in a disabled state, the washing machine is controlled to execute a standby process for waiting for the local machine to send a control instruction, and Step S4 is proceeded; and S4, the control is ended.

In the above steps, the washing machine determines the state of the remote control function according to the state of the door lock and determines whether to continue executing the program before the power failure. In addition to considering a safety function, the door lock substantially represents whether a user has opened a door cover of the washing machine in the power failure, so that if the user has opened it, the user may possibly take out the clothes, and then it is not necessary to continue the instruction before the power failure when the washing machine is powered on. At this time, the washing machine executes the standby process when powered on.

Further, the control method may include the following steps that:

S301, after a washing machine is restarted, whether a door lock is in a locked stale is determined; if a determination result is YES, Step S302 is proceeded; if the determination result is NO, Step S303 is proceeded;

S302, the remote control function is controlled to be in an enabled state, a program before a power failure of the washing machine is continuously executed, and Step S304 is proceeded;

S303, whether a door cover is in a closed state is detected; if a determination result is YES, the door lock is controlled to be in a locked state, and the remote control function is enabled, the washing machine is controlled to execute a standby process, and Step S304 is proceeded: if the determination result is NO, a user is prompted to close the door cover, the remote control function is controlled to be in the enabled state when/after it is detected that the door cover is closed, the washing machine is controlled to execute the standby process, and Step S304 is proceeded; and S304, the control is ended.

In Step S303, because the door lock is in the unlocked state, the state of the door cover is continuously detected. If the door cover is in an opened state, the user is prompted to close the door cover, and when/after it is detected that the door cover is closed, the remote control function is controlled to be in the enabled state, and the washing machine is controlled to execute the standby process. If the door cover is in a closed state, the door lock is controlled to be in the locked state, the remote control function is enabled, and the washing machine is controlled to execute the standby process. The standby process is that the washing machine temporarily stops executing a command, and waits for the intelligent terminal or the local machine to send an instruction for continuing executing the program before the power failure or the process of re-controlling the washing machine.

Preferably, the above Step S2 or S302 may also include the following steps that:

S201, the washing machine pauses and establishes communication with the intelligent terminal, but does not authorizes the intelligent terminal to remotely control it, and the washing machine prompts, through a display screen and/or the intelligent terminal, the user to whether to continue executing the program before the power failure, and if the user selects YES, Step S202 is proceeded, or Step S203 is proceeded;

S202, the remote control function is controlled to be in the enabled state, the program before the power failure of the washing machine is continuously executed, and Step S4 or S304 is proceeded; and S203, the establishment of live communication between the washing machine and the intelligent terminal is maintained, the remote control function is controlled to be in the disabled stale, namely the intelligent terminal is forbidden to remotely control the washing machine, and Step S4 or S304 is proceeded.

In the above steps, the establishment of the communication between the washing machine and the intelligent terminal means that the intelligent terminal may monitor the state information of the washing machine side in real time, such as which step of the program, the rotating speed of a rotary drum and the height of a water level. However, it is different from that in the enabled state of the remote control function, that is, when the washing machine communicates with the intelligent terminal, the intelligent terminal may not send a control instruction to the washing machine, or the intelligent terminal sends a control instruction to the washing machine, but the washing machine does not execute it. The intelligent terminal may send the control instruction to control the washing machine to execute the instruction only when the remote control function of the washing machine is in the enabled state.

Preferably, in Step S3, when the washing machine is controlled to execute the standby process for waiting for the local machine to send the control instruction, the washing machine also executes a prompt program for prompting the user to select to re-control the washing machine or to continue the program before the power failure of the washing machine, and is controlled to execute a corresponding action according to a selection result of the user.

Preferably, in the prompt program, if the washing machine detects that the user selects to re-control the washing machine, the standby process for waiting for the user to input the control instruction is executed. If the washing machine detects that the user selects to continue the program before the power failure of the washing machine, a progress before the power failure of the washing machine is acquired, and the washing machine is controlled to continue executing the program before the power failure according to the progress.

Preferably, the washing machine includes a couch display screen. The prompt program includes that: the washing machine pops up a dialog box through the touch display screen, and on the dialog box, the user selects whether to continue the program before the power failure of the washing machine.

Preferably, the dialog box includes textual information, confirm option and cancel option corresponding to the textual information. If the washing machine detects that the confirm option is selected, the program before the power failure is continued being executed. If the washing machine detects that the cancel option is selected, the standby process for waiting for the user to input the control instruction is executed.

Preferably, in Step S2, the control method further includes the following steps that:

S101, a washing machine progress before the power failure of the washing machine is retrieved, whether the washing machine is in a dewatering stage at the time of power failure is determined, if a determination result is YES, Step S102 is proceeded, and if the determination result is NO, Step S103 is proceeded;

S102, the washing machine is controlled to re-enter the dewatering program and executes subsequent programs, and Step S4 is proceeded; and S103, the washing machine is controlled to continue executing the program before the power failure from the lime of power failure according to set parameters before the power failure of the washing machine, and Step S4 is proceeded.

Preferably, in the above steps, if it is determined that the washing machine is in the dewatering stage at the time of power failure, it cannot be the same as in other stages at the time of power failure that the washing machine continues to execute the program before the power failure from the time point of power failure after being powered on and restarted, because during dewatering, it will take certain time to reach the rotating speed of dewatering. Therefore, the washing machine may be directly controlled to re-execute the dewatering program. Of course, the washing machine may retrieve a rotating speed and duration of a dewatering drum at the time point of power failure. After the washing machine is restarted, it does not re-execute the dewatering program, but controls the rotating speed of the dewatering drum to reach the rotating speed at the time point of power failure and then starts timing, and the washing machine is controlled to execute the dewatering program of the remaining time.

Preferably, the washing machine includes a lower washing drum and an upper washing drum arranged at the top of the lower washing drum. After the washing machine is restarted, the remote control function is controlled to be enabled/disabled according to a state of a door lock of the upper washing drum and/or the lower washing drum.

Preferably, after the washing machine is restarted, the remote control function is controlled to be enabled-disabled according to the state of the door lock of the lower washing drum.

In the above solution, the lower washing drum is at a relatively low position, so that it is a safely protection region. Therefore, in the present embodiment, it can be designed that the remote control function may be controlled to be enabled-disabled according to the state of the door lock of the lower washing drum, and the state of the door lock of the upper washing drum is not related to the enabling disabling of the remote control function.

Preferably, the washing machine may be remotely control led through the intelligent terminal. When the intelligent terminal is in communication connection with the washing machine, the intelligent terminal displays state information of the washing machine in real time, and needs to acquire authorization from the washing machine to send a remote control instruction to control a working state of the washing machine.

Preferably, if the washing machine is remotely controlled through the intelligent terminal before the power failure, after the washing machine is powered off and then restarted, the intelligent terminal is authorized/forbidden to remotely control the washing machine according to the unlocked/locked state of the door lock.

Through the adoption of the above technical solution, the present embodiment has the following beneficial effects.

The washing machine control method of the present embodiment mainly defines a control method for a washing machine during the execution of the remote control function after the washing machine is powered off and then restarted. The enabling/disabling of the remote control function specifically represents that: the washing machine authorizes forbids the intelligent terminal that controls the washing machine before the power failure to continue to control this washing machine after the washing machine is powered on to be restarted. The washing machine control method of the present embodiment is applicable to the field of Internet of Things washing machines and suitable for control of a washing machine after the washing machine is powered off unexpectedly and then restarted, and may effectively guarantee the safety of the Internet of Things washing machine in the remote control and avoid occurrence of safety accidents. When the washing machine is suddenly powered off unexpectedly in the remote control, after the washing machine is restarted, a potential safety hazard may exist if the intelligent terminal is directly continuously authorized to remotely control the washing machine. For example, if someone opens the door cover of the washing machine and does an action (taking out clothes, no more washing) in the power failure of the washing machine, after the washing machine is restarted, the intelligent terminal is directly authorized to continue to control the washing machine, and a remote user does not know that the clothes have been taken out, which may cause the washing machine to idle, and there is a potential safety hazard. Therefore, after the washing machine is restarted, it is necessary to detect whether the washing machine is operated by a person in the power failure to determine whether to continue to authorize the intelligent terminal to remotely control the washing machine. Whether the washing machine is operated by a person (for example, whether someone opens the door cover to take out the clothes) may be determined according to the state of the door lock of the washing machine. Therefore, the safety of users and the safety of the washing machine are fully considered in the design of the washing machine control method of the present embodiment, so that the safety of the Internet of Things washing machine in the remote control may be effectively guaranteed, and the occurrence of the safety accidents is avoided.

Embodiment II

The present embodiment discloses a washing machine using the washing machine control method in Embodiment I.

The washing machine includes: an upper washing drum, a lower washing drum, a controller and an intelligent terminal.

The upper washing drum is arranged at the top of the lower washing drum. The upper washing drum and the lower washing drum may cooperate with each other for use, or may be used independently.

The controller is connected with a wireless module for wireless connection with the intelligent terminal.

The intelligent terminal is configured to remotely control the washing machine.

The washing machine may establish communication with the intelligent terminal. When the washing machine establishes communication with the intelligent terminal, the intelligent terminal may monitor the slate information of the washing machine side in real time, such as which step of the program, the rotating speed of a rotary drum and the height of a water level. However, it is different from the enabled state of the remote control function that although the washing machine communicates with the intelligent terminal, the intelligent terminal may not send a control instruction to the washing machine, or the intelligent terminal sends a control instruction to the washing machine, but the washing machine does not execute it. The intelligent terminal may send the control instruction to control the washing machine to execute the instruction only when the remote control function of the washing machine is in the enabled state.

Further, the washing machine is provided with an activation device, and the washing machine authorizes/forbids the intelligent terminal to remotely control the washing machine through the activation device. That is, the intelligent terminal sends a remote control request to the washing machine. The washing machine detects whether the activation device is activated after receiving the request. If a detection result is YES, when the state information of the washing machine is Safe, the washing machine authorizes the remote control function to be enabled, or it keeps the remote control function in the disabled state.

If the remote control function is in the enabled state before the washing machine is powered off, it is not necessary to authorize/forbid the intelligent terminal through the activation device to remotely control the washing machine after the washing machine is powered off and then restarted, but the washing machine directly detects whether its state information meets a safety requirement of remote control. If a determination result is YES, the remote control function is directly enabled, or the remote control function is continuously kept in the disabled state. Determining whether the state information of the washing machine meets the safety requirement of remote control at least includes determining whether the stale of the door lock of the lower washing drum is in the locked state. If the state of the door lock of the lower washing drum is in the locked state, it is determined that the stale information of the washing machine meets the safety requirement of remote control. If the state of the door lock of the lower washing drum is in the unlocked state, it is determined that the slate information of the washing machine does not meet the safety requirement of remote control.

Preferably, the activation device is detachably arranged on the washing machine, or is placed within a certain range around the washing machine. When the washing machine needs to be remotely controlled, only a pre-controller may acquire personally or other people in front of or near the washing machine may acquire the authorization of the washing machine by triggering the activation device to remotely control the washing machine. That is, someone, intending to remotely control the washing machine, must personally activate the activation device near the washing machine, so that after the washing machine is remotely controlled, a safety check is forced to be executed. Therefore, the safety of the washing machine in the remote control is improved.

Preferably, the activation device includes a near-field identification unit. When the intelligent terminal is within an identification range of the near-field identification unit, the washing machine authorizes the intelligent terminal to remotely control the washing machine.

Specifically, the activation device includes a Near-Field Communication (NFC) card reader. An NFC label is arranged on the intelligent terminal. After the NFC label falls within a reading range of the NFC card reader, the NFC card reader is in a triggered state, and the washing machine authorizes the intelligent terminal to remotely control the washing machine. Of course, in the present embodiment, the activation device is not limited to using an NFC technology. A Radio Frequency Identification (RFID) card reader may also be arranged on the washing machine. An RFID label is arranged on the intelligent terminal. The specific principle is the same as the above, and no more repeated details are described here. Of course, the NFC card reader may also be arranged on the washing machine.

Preferably, the controller of the washing machine is in communication connection with the NFC card reader, and periodically detects the triggering unit. If the triggering unit is in the triggered state, the controller authorizes the intelligent terminal to remotely control the washing machine.

Preferably, the activation device includes an activation button. The washing machine includes the controller. The activation button is connected with the controller in a wired or wireless manner. The activation button includes a communication module for communication connection with the controller, and a detection module for detecting whether the button is triggered. If the detection module detects that the activation button is triggered, it transmits a signal to the controller through the communication module, and the controller authorizes the intelligent terminal to remotely control the washing machine after receiving the signal.

The activation device includes an activation button arranged on a case body of the washing machine. The activation button is in communication connection with the controller of the washing machine. If the activation button is triggered, the controller of the washing machine authorizes the intelligent terminal to remotely control the washing machine. In order to prevent misoperation, such as misoperation from a child, a box body capable of being opened and closed is arranged on the washing machine. The activation button may be placed in the box body, so as to effectively prevent the misoperation from the child.

It should be noted that in the present disclosure, the unlocked/locked state of the door lock refers to an unlocked state or a locked state of the door lock.

The above descriptions are only preferred embodiments of the present disclosure, but not intended to limit the present disclosure in any forms. Although the present disclosure is disclosed above by the preferred embodiments, the preferred embodiments are not intended to limit the present disclosure. Any person skilled in the an can make some changes by using the above-mentioned technical contents or modify the technical contents as equivalent embodiments of equivalent changes without departing from the scope of the technical solution of the present disclosure. Any simple alterations, equivalent changes and modifications that are made to the above embodiments according to the technical essence of the present disclosure without departing from the contents of the technical solution of the present disclosure shall all fall within the scope of the solution of the present disclosure.

The invention claimed is:

1. A method for controlling a washing machine having a remote control function, wherein after the washing machine is powered off due to a power failure of the washing machine and is restarted, the remote control function is controlled to be enabled or disabled according to an unlocked or a locked state of a door lock, the method comprising:

performing Step S1, which includes, after the washing machine is restarted, determining whether the door lock is in the locked state, wherein, if the door lock is in the locked state, performing Step S2, which includes controlling the remote control function to be in the enabled state, continuing executing a program which is executed before the power failure of the washing machine, and proceeding to Step S4, which includes ending the control, and wherein, if the door lock is in the unlocked state, performing Step S3, which includes controlling the remote control function to be in the disabled state, controlling the washing machine to execute a standby process for waiting for sending a control instruction by the washing machine, and proceeding to Step S4, which includes ending the control, wherein in Step S3, when the washing machine is controlled to execute the standby process for waiting for sending the control instruction by the washing machine, the washing machine also executes a prompt program for prompting the user to select to re-control the washing machine or to continue executing the program which is executed before the power failure of the washing machine, and the washing machine is controlled to execute a corresponding action according to a result selected by the user.

2. The method for controlling the washing machine according to claim 1, wherein controlling the remote control function to be enabled or disabled according to the unlocked or the locked state of the door lock comprises:

detecting whether the door lock is in the locked state after the washing machine is restarted;

in response to detecting that the door lock is in the locked state enabling the remote control function; and in response to detecting that the door lock is in the unlocked state, controlling the remote control function to be in a disabled state.

3. The method for controlling the washing machine according to claim 1, wherein: in the prompt program, if the washing machine detects that the user selects to re-control the washing machine, the standby process for waiting for inputting the control instruction by the user is executed; and if the washing machine detects that the user selects to continue executing the program which is executed before the power failure of the washing machine, a progress before the power failure of the washing machine is acquired, and the washing machine is controlled to continue executing the program which is executed before the power failure according to the progress.

4. The method for controlling the washing machine according to claim 3, wherein: the washing machine comprises a touch display screen; the prompt program comprises: the washing machine pops up a dialog box on the touch display screen, and on the dialog box, the user selects whether to continue executing the program which is executed before the power failure of the washing machine.

5. The method for controlling the washing machine according to claim 1, wherein: Step S2 further comprises the following steps:

Step S101, which includes retrieving the progress which is executed before the power failure of the washing machine, determining whether the washing machine is executing a dewatering program at the moment of the power failure, wherein if the determination result is YES, proceeding to Step S102, which includes controlling the washing machine to re-enter the dewatering program and execute subsequent programs, and proceeding to Step S4, and wherein if the determination result is NO, proceeding to Step S103 which includes controlling the washing machine to continue executing the program before which is executed the power failure from a time point of the power failure according to set parameters, and proceeding to Step S4.

6. The method for controlling the washing machine according to claim 1, wherein: the washing machine comprises a lower washing drum and an upper washing drum arranged above the lower washing drum; after the washing machine is restarted, the remote control function is controlled to be enabled or disabled according to a state of a door lock of the upper washing drum and/or the lower washing drum.

7. The method for controlling the washing machine according to claim 1, wherein: the washing machine is remotely controlled through an intelligent terminal; when the intelligent terminal is in communication connection with the washing machine, the intelligent terminal displays state information of the washing machine in real time, and the intelligent terminal sends a remote control instruction to control a working state of the washing machine after acquiring authorization from the washing machine.

8. A washing machine using the method for controlling the washing machine according to claim 1.

9. The method for controlling the washing machine according to claim 4, wherein: the dialog box comprises textual information, a confirm option and a cancel option corresponding to the textual information;

if the washing machine detects that the confirm option is selected, the program before the power failure is continued being executed; if the washing machine detects that the cancel option is selected, the standby process for waiting input the control instruction by the user is executed.

10. The method for controlling the washing machine according to claim 6, wherein: after the washing machine is restarted, the remote control function is controlled to be enabled or disabled according to the state of the door lock of the lower washing drum.

11. The method for controlling the washing machine according to claim 2, wherein: the washing machine comprises a lower washing drum and an upper washing drum arranged above the lower washing drum; after the washing machine is restarted, the remote control function is controlled to be enabled or disabled according to a state of a door lock of the upper washing drum and/or the lower washing drum.

12. The method for controlling the washing machine according to claim 7, wherein: if the washing machine is remotely controlled through the intelligent terminal before the power failure, after the washing machine is powered off and then restarted, the intelligent terminal is authorized or forbidden to remotely control the washing machine according to the unlocked or the locked state of the door lock.

13. The method for controlling the washing machine according to claim 2, wherein: the washing machine is remotely controlled through an intelligent terminal; when the intelligent terminal is in communication connection with the washing machine, the intelligent terminal displays state information of the washing machine in real time, and the intelligent terminal sends a remote control instruction to control a working state of the washing machine after acquiring authorization from the washing machine.

* * * * *